United States Patent [19]

Ng et al.

[11] Patent Number: 4,512,653

[45] Date of Patent: Apr. 23, 1985

[54] METHOD AND APPARATUS FOR THERMALLY-ASSISTED GROUNDING OF AN ELECTROGRAPHIC IMAGING MEMBER

[75] Inventors: Yee S. Ng, Rochester; James G. Jarvis; John R. Thompson, both of Webster, all of N.Y.

[73] Assignee: Eastman Kodak Company, Rochester, N.Y.

[21] Appl. No.: 504,759

[22] Filed: Jun. 15, 1983

[51] Int. Cl.[3] ..... G03G 15/12

[52] U.S. Cl. ..... 355/16; 355/3 R; 355/77; 361/212; 361/220

[58] Field of Search ..... 355/16, 3 R, 9, 30, 355/133, 77; 361/212, 220, 221; 430/31

[56] References Cited

U.S. PATENT DOCUMENTS

| | | | |
|---|---|---|---|
| 2,955,938 | 10/1960 | Steinhilper | 96/1 |
| 3,533,692 | 10/1970 | Blanchette et al. | 355/16 |
| 3,620,614 | 11/1971 | Gunto | 355/3 |
| 3,639,121 | 2/1972 | York | 96/1.5 |
| 3,738,855 | 6/1973 | Gundlach | 117/17.5 |
| 3,743,410 | 7/1973 | Edelman et al. | 355/15 |
| 3,910,475 | 10/1975 | Pundsack et al. | 226/6 |
| 4,027,967 | 6/1977 | Euler | 355/16 |
| 4,344,698 | 8/1982 | Zeman | 355/16 |
| 4,402,593 | 9/1983 | Bernard et al. | 361/221 X |

*Primary Examiner*—Richard L. Moses

*Attorney, Agent, or Firm*—John D. Husser

[57] ABSTRACT

Apparatus is disclosed for softening and displacing electrically insulative material on a portion of the surface of an electrographic imaging web by heat and pressure to effect electrical contact (e.g. grounding) with an isolated conductive layer thereof. One apparatus embodiment maintains a constant tension in the web which urges the insulative material into pressure contact with flanges on each end of a heated aluminum roller. The roller makes electrical contact with a conductive layer of the web when the softened insulative material is displaced from between the roller and the conductive layer. Means for protecting the center of the web from the heat supplied to the roller and means for preventing a buildup of insulative material on the flanges of the roller are disclosed.

13 Claims, 3 Drawing Figures

METHOD AND APPARATUS FOR THERMALLY-ASSISTED GROUNDING OF AN ELECTROGRAPHIC IMAGING MEMBER

BACKGROUND OF THE INVENTION

1. Field of the Invention

The present invention relates to electrographic imaging methods and apparatus of the type utilizing an image member having an electrically conductive, reference-potential layer sandwiched between electrically insulative layers, and more particularly, to methods and apparatus for producing electrical contact with such sandwiched, reference-potential layer.

2. Description of the Invention Relative to Prior Art

In electrographic imaging, image quality is dependent upon establishing a reference potential, e.g. ground or another predetermined reference level, for the image medium. For this purpose, an electrically conductive layer is commonly incorporated in the imaging medium between an insulative film support and a photoconductive insulator layer. Various means have been used to establish and maintain the necessary reference potential on such an insulatively sandwiched conductive layer. U.S. Pat. No. 4,344,698 discloses a useful knife-edge grounding apparatus for this purpose. However, cutting through the insulating material damages the web and may lead to contamination of the image area by the cutting debris. Also, the knife sharpness must be maintained.

A reference potential may be provided without mechanical contact with the web by a corona discharge as described in U.S. Pat. Nos. 2,955,938; 3,620,614 and 3,738,855. The high voltage apparatus required to provide the desired potential difference by the corona discharge method is expensive and requires periodic readjustment and maintenance.

Various mechanical contact means have also been disclosed for use with specially configured webs. For example, one or more insulative layers in these webs may be bridged by added conductive material, as disclosed in U.S. Pat. Nos. 3,639,121 and 3,743,410. Alternatively one or more insulative layers may have discontinuities that provide direct access to the conductive layer, as disclosed in U.S. Pat. Nos. 3,533,692 and 3,910,475. However, the complex structure of such specially configured webs increases the cost of coating and finishing operations required to manufacture the web. From the fabrication viewpoint, it is advantageous to coat a wide web uniformly from edge to edge without striping, edging or pattern screening steps and subsequently slit it to narrower widths. During such slitting operations portions of the photoconductor or support layer frequently are displaced over the edge of the conductive layer and further isolate it from electrical contact.

SUMMARY OF THE INVENTION

It is a purpose of the present invention to provide method and apparatus for establishing a reference potential on the conductive layer of such electrographic imaging medium without the problems mentioned above. Thus, one advantage of the present invention is that it effects electrical contact without the necessity of special media fabrication techniques. Other advantages of the present invention are that it performs reliably with small maintenance and effects no damage to the electrographic media used. The present invention provides for electrical coupling of the conductive layer of such electrographic imaging members to a reference potential source without the debris and damage associated with cutting operations and without requiring additional, expensive high voltage charging apparatus.

In accordance with the present invention such electrical contact is established with such a covered conductive layer by heating a portion of at least one of its electrically insulative coverings (i.e. the normally insulative photoconductor layer and insulative support) until it softens, and urging pressure contact between the softened portion and electrical contact means so that the softened insulative material is displaced and a useful electrical connection is formed between the contact means and the conductive layer. In one aspect, the invention includes means for heating the insulative material until it is softened, an electrically conductive contact member, and means for producing pressure contact between the heated insulative material and the contact member so as to displace the softened insulative material and produce electrical contact between the contact member and the conductive layer.

BRIEF DESCRIPTION OF THE DRAWINGS

In the description of a preferred embodiment below reference is made to the accompanying drawing, in which.

In these figures like parts are assigned like reference numerals.

DETAILED DESCRIPTION OF A PREFERRED EMBODIMENT

Figure 1:
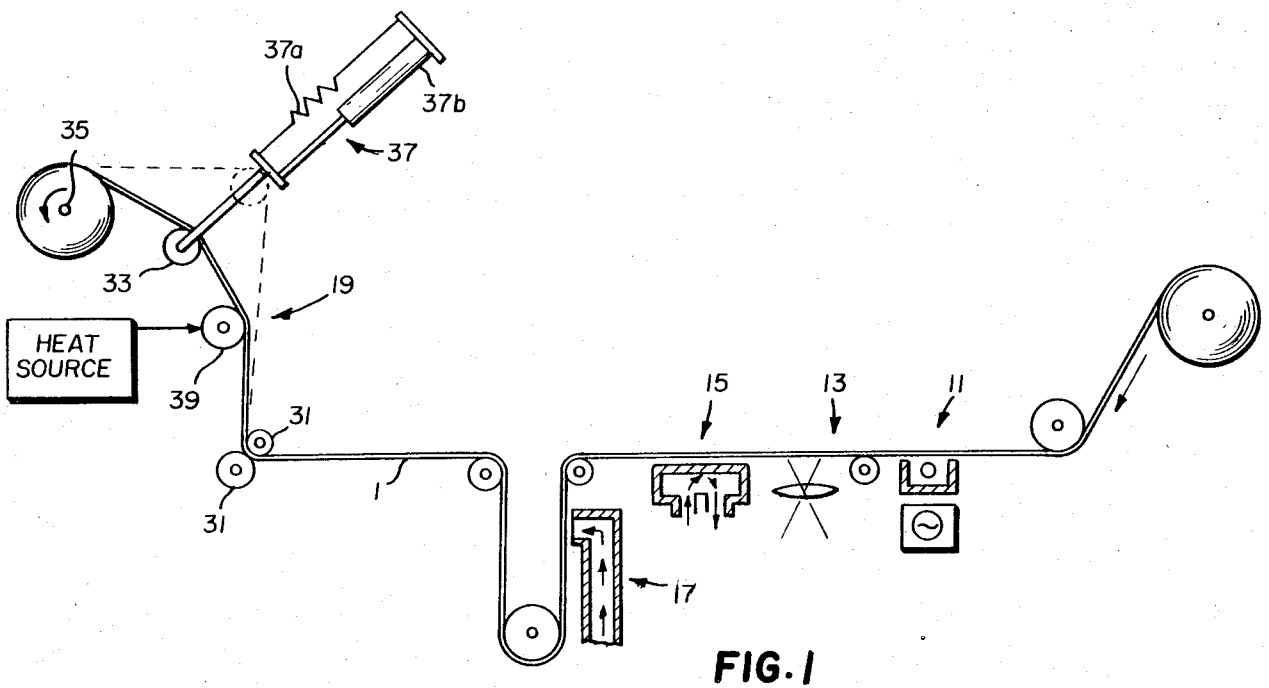
FIG. 1 is a schematic diagram of an electrographic imaging apparatus.

Referring to FIG. 1, an electrographic imaging apparatus adapted for use with image medium or member in the form of a photoconductor web 1 is shown. As shown in the section view in FIG. 2, the web 1 comprises a conductive layer 3 covered on one side by a layer of photoconductor material 5 and on the other side by an insulative support material 7. The photoconductor material layer is softenable by heat and thus thermoplastic. The support material layer 7 may also be thermoplastic.

The electrographic apparatus comprises a corona charging station 11 for applying a uniform primary charge, an exposure station 13 for forming a latent electrostatic image, a developer station 15 for applying toner to the electrostatic image, a fusing station 17 for fixing the toner image and a device 19 for establishing reference potential (e.g. grounding) on the web. Because other elements of electrophotographic imaging apparatus of this general type are well known, the present description will be directed in particular to elements forming part of, or cooperating directly with, the web contacting device 19.

In accord with the preferred embodiment of the invention shown in FIG. 1, the photoconductor web leaving fusing station 17 passes between a pair of pinch rollers 31 and over a guide roller 33 to a constant torque take-up reel 35. The guide roller 33 is mounted on a control assembly 37 including spring means 37*a* and an air piston 37*b* which is adapted to displace the web between the dotted and solid-line positions shown in FIGS. 1 and 2. The control assembly thus moves the web out of and into operative relation with contacting device 19 for establishing a reference potential on the web conductive layer 3.

When piston 37*b* is inactivated and spring 37*a* retracts to the dotted-line position, pinch rollers 31 prevent guide roller 33 from pulling the web from fusing station 17. Substantially constant tension is maintained in the web 1 between pinch rollers 31 and take-up reel 35 by the constant torque drive force provided by take-up reel 35. The constant-torque drive prevents breakage and loss of tension in the web by slowing the speed of (or allowing web to be pulled from) the take-up reel while roller 33 is retracting and increasing the speed of take-up reel 35 while piston 37*b* is extending. When the air piston 37*b* is activated it extends the guide roller 33 to the solid-line position and the web 1 is urged into pressure contact with the heated grounding roller 39 by the tension maintained in the web by the take-up reel 35.

In a preferred embodiment the grounding roller 39 rotates at a surface speed about equal to the surface speed of the web which it engages. This can be effected by allowing the web to drive roller 39 as an idler or by synchronizing drive of roller 39 with rollers 31. Engagement of the moving web with the rotating surface of roller 39 heats the insulative material 5 to soften it. The pressure contact between the roller 39 and the web 1 displaces the softened insulative material 5 laterally, producing highly useful electrical connection between the roller 39 and the conductive layer 3. In this regard, it is preferred that the photoconductor layer be the surface engaging the contact member. In this mode the mechanism of electrical connection (i.e. lowering of electrical resistance between the roller and the conductive layer) can be enhanced by increased conductivity of the photoconductor due to heating as well as by the increased proximity or physical contact. After leaving the heated roller 39, the insulative layer is cooled by ambient air; and when it reaches take-up reel 35, the surface is firm enough to be spooled without adhesion between the wraps of film on the reel.

Figure 2:
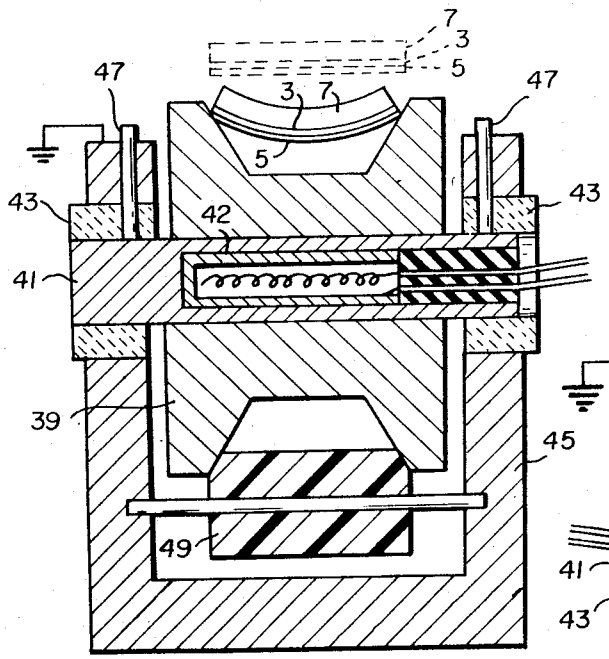
FIG. 2 is a section view of a portion of the FIG. 1 apparatus showing the electrographic imaging web drawn against a grounding roller in accordance with one preferred embodiment of the present invention.

One preferred embodiment of contacting device 19 is shown in more detail in FIG. 2. Thus roller 39 is formed of aluminum so as to be thermally and electrically conductive and is mounted for rotation on a heater rod 41. The surface of the outer portion of heater rod 41, on which roller 39 rotates, is electrically conductive and the heater rod 41 is supported by blocks 43 of thermally insulative material such as mica, which thermally isolate the heater rod 41 from frame 45 and enhance heating efficiency. The surface of rod 41 is electrically insulated from, but in good thermal transfer relation with, the electrical coil 42 which heats the rod 41. The aluminum roller 39 is in electrical contact with the surface of heater rod 41 and is electrically coupled to the grounded frame 45 via the heater rod and a grounding screw 47, which extends into frame 45 and through each bearing block 43 to the conductive surface of the heater rod 41.

As shown in FIG. 2, the roller 39 has tapered flanges which are predeterminedly constructed to cooperate with the image member. That is, it is highly preferred that the roller flanges soften and displace only the edge photoconductor layer portions and suspend the remainder of that layer in spaced relation from other roller portions. The inward taper from outer to inner radial positions accomplishes this function simply and effectively.

A cylindrical brush 49 is mounted in frame 45 parallel to roller 39 and preferably is rotated so that its roller-engaging surface moves in the opposite direction to that of the engaged surface of roller 39. The brush is constructed e.g. with bristles or a skiving surface so that any photoconductor material adhering to the grounding roller 39 is removed by brush 49. This prevents electrically insulative material from accumulating on the roller 39.

Figure 3:
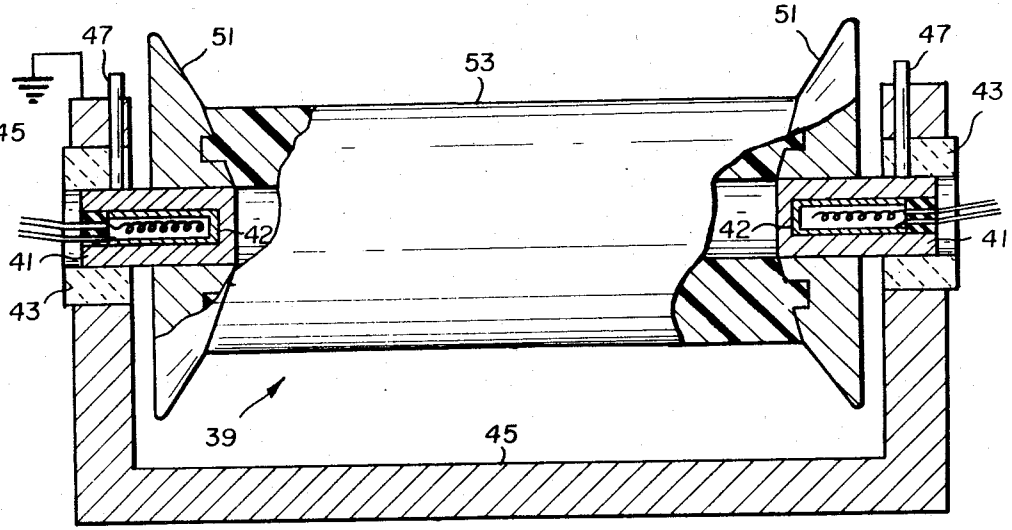
FIG. 3 is a view similar to FIG. 2 showing another embodiment of the present invention.

Referring to FIG. 3, another preferred contacting device construction is illustrated. In this embodiment two conductive roller portions 51, formed as the flanges, are mounted in coaxial alignment with a thermally insulative cylinder 53 mounted between them. Cylinder 53 provides thermal protection and additional support for the center portions of wide or very flexible webs which might curve into contact with the roller. One or both of the roller portions 51 is heated and grounded by means of rod 41 and grounding screws 47 as described above.

The temperature to which the contacting portions of the contact member should be heated will depend on the particular parameters (e.g. the glass transition temperature of the photoconductor layer, the speed of web feed, the contact zone between heating surface and the web edges and the magnitude of pressure contact between web and roller) of electrographic system in which the present invention is employed. In general, the insulative layer should be heated sufficiently to soften it to a degree that renders it displaceable, by pressure contact, to an extend enabling good electrical connection or contact between an electrical contact surface and the underlying conductive layer of the electrographic imaging medium.

Examples 1–3 below will provide further illustration of the mode of operation and advantages of the present invention, as well as guidelines for useful heating and pressure parameters for exemplary imaging media.

EXAMPLE 1

A thermally-assisted grounding assembly such as described with respect to FIG. 2 was implemented in an in-line processor such as shown in FIG. 1. A roll of 16 mm electrophotographic film having a photoconductor layer with the ability to accept both polarities of charging, was used. The main corona charger used positive corona current, the toner polarity was positive, and a development electrode at the development station provided a negative-positive imaging mode. Film velocities of from 0.5 cm/sec to 5 cm/sec were tested.

The electrophotographic imaging operation began when the pinch roller drive started to move. The activation of the pinch roller drive triggered the air piston to lower the film onto the heated aluminum roller. The film's angle of wrap on the heated roller (radius = 1.25 cm) was about 40°. The tension of the film was about 36 grams per centimeter of width or about 36 dynes. The film was about 110 microns in thickness so that this tension yielded a stress of about $3.27 \times 10^3$ dynes/cm$^2$. The film edges were supported by the tapered heated flanges of the roller with the balance of the photoconductor suspended above the roller surface (solid-line position shown in FIG. 2). The roller was heated to about 177° C. Effective grounding was obtained during this imaging sequence.

When the processing was completed, the air piston was deactivated and the spring pulled the film away from the heated roller to avoid excessive heating of the film. This was also the position of the film when the system was on standby (at rest). When the spring was pulling the film away from the roller, after the pinch roller drive stopped moving, the torque motor roller released some film, therefore, no film was wasted. Similarly, when the processing started, the torque motor roller wound up the previously released film. Since the film was forced down on the heated roller during processing by the film tension as maintained by the torque motor, the thermal transfer is high between the heater and film.

To demonstrate the importance of thermally-assisted grounding, the roller temperature was reduced to 121° C. instead of 177° C. Incomplete grounding was observed. In the range of processing speeds tested (0.5 cm/sec to 5 cm/sec), a minimum temperature of 132° C. was found to be sufficient for grounding with positive corona charges on this bipolar film.

EXAMPLE 2

The thermally-assisted grounding assembly was implemented in a manner similar to Example 1 except the main corona charger used negative corona current and the toner polarity was positive (thus effecting a positive-positive imaging mode). A roll of 16 mm film, as in Example 1, was used and film velocities from 0.5 cm/sec to 5 cm/sec, were tested. Effective grounding of the conductive layer was achieved with the roller temperature at 177° C. Again, as in Example 1, the importance of thermal assistance in grounding was illustrated by a non-uniform conductive layer potential when the roller was at 121° C. It was observed that the conductive layer potential was floating around the −100 volts level. Several attempts to eliminate this floating potential by means other than the thermally-assisted roller were unsuccessful. These attempts included increasing the film tension to 72 grams per centimeter of width, increasing the angle of film wrap from 40° to 90° and changing the tapered angle of the roller to 15° or 10°. The minimum temperature for effective grounding of the film increased to 165° C. when negative corona charges were used.

EXAMPLE 3

The thermally-assisted grounding assembly was again implemented in an in-line apparatus similar to that shown in FIG. 1. The main corona charger used positive corona current and the toner polarity was positive. A roll of 16 mm film equivalent to unipolar Kodak Ektavolt photoconductive film type SO-102 was used. Film velocities of from 0.5 cm/sec to 5 cm/sec were tested. Effective grounding was observed at 36 grams per centimeter of width and 40° wrap around the heated roller at a temperature of 177° C. A minimum temperature of 132° C. was satisfactory for grounding of SO-102 film with positive charging.

It will be apparent to one skilled in the art that there are various alternative structures for implementing the present invention. For example, the insulative material may be heat-softened prior to coming into contact with the electrical contact member. Infrared edge heaters might be used to heat the film edges for this purpose. In this embodiment rod 41 might be an unheated rod having electrical continuity with roller 40 or 51 and the frame 45. Alternatively the edges of the web may be supported by unheated, insulated rollers, and grounding may be effected by a heated, electrically conductive surface(s) which are urged into pressure contact with web edges.

It will also be apparent that the medium itself could be a single sheet, rather than a continuous web. In this case a contact member, such as a heated, electrically conductive edge clamp member could be mounted for movement through the operative apparatus path with the imaging sheet to maintain reference potential.

The invention has been described in detail with particular reference to preferred embodiments thereof, but it will be understood that variations and modifications can be effected within the spirit and scope of the invention.

What is claimed is:

1. In electrographic apparatus adapted for the use, along an operative apparatus path, with an image member having an electrically conductive, reference-potential layer covered by electrically insulative thermoplastic material, a contacting device comprising:

means for heating a portion of the thermoplastic material so that such portion is softened;

an electrically conductive contact member engageable with such softened portion;

means for electrically coupling said contact member to a source of a reference potential; and means for urging pressure engagement between said softened portion of the insulative material and said contact member so that the insulative material is displaced and a low resistance electrical connection is effected between said contact member and the conductive layer.

2. The invention defined in claim 1 wherein said electrically conductive contact member comprises a surface on said heating means.

3. The invention defined in claim 1 wherein said electrically conductive contact member comprises means for supporting such image member during movement along the operative path of said apparatus.

4. The invention defined in claim 3 wherein said supporting means comprises roller means having flanges adapted to engage edges of the image member, said roller being adapted to move with the image member.

5. The invention defined in claim 4 wherein said heating means includes means for heating said roller flanges.

6. The invention defined in claim 4 further including roller cleaning means for removing from said roller insulative material picked up by said roller from such image member.

7. In electrographic apparatus adapted to produce an image on a web having layer of a conductive material covered by a layer of an electrically insulative, thermoplastic material, a contacting device comprising:

a roller adapted for rotation, said roller having flanges adapted to support the edges of the web;

an electrically conductive surface on one of said flanges;

means for electrically coupling said conductive surface to a source of reference potential;

means for urging pressure engagement between said conductive surface and a portion of such thermoplastic material; and means for heating said conductive surface so that such portion is softened;

whereby such portion is displaced and a low resistance electrical connection is effected between said conductive surface and such conductive layer.

8. Apparatus as claimed in claim 7 wherein said roller comprises an insulative cylinder mounted coaxially between said flanges so that the center of the web is protected from heat.

9. Apparatus as claimed in claim 7 wherein said roller rotates about said means for heating said conductive surface.

10. Apparatus as claimed in claim 7 wherein said means for urging pressure engagement comprises means for providing a generally constant tension in said image member.

11. Apparatus as claimed in claim 7 wherein said means for urging pressure engagement comprises:

speed control means for imparting a generally uniform speed to an image member as it enters the apparatus;

constant torque means for providing a generally uniform tension in said image member; and means for selectively engaging and disengaging said roller with said image member.

12. Apparatus as claimed in claim 11 wherein said means for selectively engaging and disengaging comprises guide means is adapted to move said image member into and out of contact with said roller.

13. A method for establishing reference potential for an image member having an electrically conductive, reference-potential layer covered by electrically insulative thermoplastic material as it moves along an electrographic imaging path, said method comprising:

heating a portion of the thermoplastic material so that such portion is softened; and urging pressure engagement between said softened portion of the insulative material and an electrical contact member so that the insulative material is displaced and a low resistance electrical connection is effected between said contact member and the conductive layer.

* * * * *